United States Patent [19]

Hart et al.

[11] Patent Number: 4,639,191

[45] Date of Patent: Jan. 27, 1987

[54] CENTRIFUGAL FAN LINER AND INSTALLING TOOL THEREFOR

[75] Inventors: Joseph D. Hart, San Marcos, Calif.; R. Leon Wells, 1649 Manor Dr., Vista, Calif. 92083

[73] Assignee: R. Leon Wells, Vista, Calif.

[21] Appl. No.: 705,230

[22] Filed: Feb. 25, 1985

Related U.S. Application Data

[63] Continuation-in-part of Ser. No. 500,079, Jun. 1, 1983, abandoned.

[51] Int. Cl.[4] ..... B23Q 3/00; F04D 29/42

[52] U.S. Cl. ..... 415/196; 269/48.4; 156/391

[58] Field of Search ..... 415/196, 197, 128, 170 R; 15/412; 292/256, 257; 156/293, 294, 391, 597; 24/71.1, 71.2, 68 CD, 68 CT; 269/48.4, 48.3, 48.1

[56] References Cited

U.S. PATENT DOCUMENTS

| | | | |
|---|---|---|---|
| 797,058 | 8/1905 | Hedlund | 415/196 |
| 1,283,393 | 10/1918 | Barry | 156/391 X |
| 2,121,068 | 6/1938 | Buechler | 415/196 X |
| 2,246,859 | 6/1941 | Pierce | 415/197 X |
| 2,365,787 | 12/1944 | Wallace | 269/48.4 |
| 3,136,013 | 6/1964 | Funk et al. | 415/196 X |
| 3,607,600 | 9/1971 | Schreter et al. | 415/197 X |
| 3,829,238 | 8/1974 | Speck | 415/197 |
| 4,305,068 | 12/1981 | Hurst | 415/196 X |

FOREIGN PATENT DOCUMENTS

| | | | |
|---|---|---|---|
| 555808 | 9/1943 | United Kingdom | 415/196 |

*Primary Examiner*—Robert E. Garrett
*Assistant Examiner*—Joseph M. Pitko
*Attorney, Agent, or Firm*—John J. Murphey

[57] ABSTRACT

In the centrifugal fan unit of an upright vacuum cleaner, the improvement of a metal liner to rehabilitate a worn out fan chamber or to improve the performance of a new centrifugal fan unit comprising a metal plate having an overall shape and size as the original fan chamber in its new condition and an assembly for mounting the liner in the chamber comprising a clamp fully manipulative from only one side of the vacuum cleaner base including a squeezable handle, a shaft passing fore and aft through the handle adapted for reciprocating movement relative to the handle, a bar on the shaft to allow it to pass through the base and reversibly abut the opposite side of the first chamber, a fan blank slidingly received on the shaft to abut the liner over substantially its full surface, a spring cooperative with the squeezable handle to draw the bar and fan blank together to squeeze the liner tightly against the base and a lever to release the clamp when the adhesive is set to hold the liner in position.

2 Claims, 7 Drawing Figures

CENTRIFUGAL FAN LINER AND INSTALLING TOOL THEREFOR

CROSS-REFERENCE TO RELATED APPLICATIONS

This application is a continuation-in-part of a previous patent application titled CENTRIFUGAL FAN LINER, Ser. No. 500,079, filed 06/01/83 and now abandoned.

BRIEF SUMMARY OF THE INVENTION

This invention pertains to centrifugal fans, means for rehabilitating worn out fan units as well as improving their original performance and a tool for installing them. More particularly, this invention pertains to centrifugal fans that are used in upright vacuum cleaners, especially those of modern design and construction wherein the fan unit is almost totally constructed of plastic parts, and a special tool used to install them in a convenient manner.

Centrifugal fans are used to produce high inlet vacumm or suction and/or high outlet pressure, depending upon the desired use, by the effect of spinning a fan inside an involute chamber. Air is drawn in an opening in one wall of the involute near the center of the fan, caused to spin at high velocity around the inside of the chamber and then is discharged through an opening at the end of the involute, i.e., the furthest point from the involute center. For good intake vacuum or high outlet pressure, fan-wall clearance must be maintained very small and fan rotation speed very high. Any wear of the walls or fan blades will decrease operating values and reduce overall efficiency. Replacement of fan and outer wall components are often costly and require substantial downtime.

Specifically, in upright vacuum cleaners, characterized by having a rollable base that houses the centrifugal fan, floor brush, wheels, etc. and that supports an upright push-pull handle carrying an air-dirt separator bag, the centrifugal vacuum fan is many times made entirely of plastic and is housed in an injection-molded plastic base. The cost saving in using plastic parts is well-known and the light weight of the plastic parts makes these vacuum cleaners easier to handle. The vacuum cleaner centrifugal vacuum fan is positioned parallel or flat to the floor and is characterized by an involute-shaped centrifugal fan flat bottom depression molded into the base that is made into an enclosed fan chamber by addition of a second, parallel involute-shaped plastic chamber wall placed over top thereof in spaced-apart relation thereto. An inlet hole is formed in the lower chamber wall and communicates via a duct to the floor brush chamber. An outlet opening is formed in the plastic wall that surrounds and confines the two involute-shaped chamber walls. A fan plate with upstanding radially positioned fan blades is operably mounted within the chamber to spin at high rpm in close tolerance with the chamber walls and the separating wall around the perimeter thereof. Air is sucked or drawn in through the inlet in the bottom chamber wall bringing dirt and debris with it, spun at high velocity and the air compressed by centrifugal force such that the air and debris are discharged at high pressure and velocity into the air-dirt separator bag.

Problems indigenous to these vacuum cleaner centrifugal fans are caused by cinders, paper clips, buttons, coins, nails, screws and other hard items being sucked or swept into the fan chamber inlet during normal cleaning of rugs or floors. These hard objects scour the chamber walls during their travel around the involute chamber and chip away and sometimes puncture the separating wall, especially the injection-molded separating wall, resulting in reduced tolerances and loss of vacuum. Where punctures occur, an additional problem arises in that the dirt and other debris being swept up is ejected from the vacuum cleaner back onto the floor or dispersed into the air. Also, these objects many times "catch" momentarily in the fan chamber causing the plastic radial fan blades to pass over them and chip or break off. Any fracture in the fan blades immediately results in unbalancing of the fan and causes severe stress to the shaft bearings and seals.

To avoid some of these problems, the vacuum cleaner manufacturers have opened up the fan blade-chamber wall clearance so that debris does not "catch" as often. The low fan vacuum pressure from the increased clearance is somewhat overcome by using higher fan speeds. Unfortunately, the fan and the chamber are now in a more precarious situation because, at higher fan speeds and air velocity, any small object such as a paper clip will act like a bullet and will almost surely result in a broken fan blade or a hole punched through the chamber perimeter wall. This is true when the fan chamber is made from cast metal, such as in a cast aluminum vacuum cleaner base, but is especially a problem in the molded, one-piece plastic vacuum cleaner base.

Replacement of the fan blade is moderately expensive as it requires the fan chamber to be disassembled as well as the fan replaced. However, mere replacement of the fan blade alone will not usually be enough because the chamber walls are already scoured and chipped by the object that broke the fan blades and further entrance of objects into the wall-roughened chamber will cause more catching and breakages. Thus, the chamber walls should be replaced as well as the fan. With the chamber being made as part of an injection molded or cast base, the whole base requires replacement—a cost of ten to twenty times the cost of the fan blade.

This invention comprises a thin metal liner for installation in both new and worn centrifugal fan units, especially those used in upright vacuum cleaners. It comprises a flat plate substantially the same size and shape as the involute plastic chamber wall that is molded into the vacuum cleaner base and an upstanding metal wall that is attached to the plate's involute perimeter and is high enough to span the distance between the chamber walls when they are assembled. The liner is mounted in the new or worn chamber in tight registration with the edges of the fan chamber outlet to center the liner over the inlet opening and to prevent interference with the revolving fan blades. Because the liner is thin, it must be glued into place as opposed to using screws or rivets that have protruding heads. It is so thin that areas not fully glued to the base may begin vibrating in the high velocity air stream and may become noisy or fatigued. In addition to being thin and flexible, the liner has a large flat middle area. If pressure is only applied to the liner's perimeter during installation, this middle area buckles upward causing clearance problems with the fan. Total area clamping will restrain the deformation problem but it is difficult to achieve because the base, with its motor, brushes, wheels and attached upright push-pull handle, is heavy and very awkward to position within a clamp or vice-versa. Thus, this invention also includes a portable clamp, fully manipulative from only one side of the base that provides full pressure substantially over the full floor or flat surface of the liner to achieve quick and accurate positioning of the liner in the base while the adhesive is curing and that can be quickly and easily removed after the adhesive has cured.

When installed in new vacuum cleaner bases, the gap or air space between the fan blades, the chamber walls and the perimeter wall is reduced causing an increase in suction. When installed in a worn vacuum cleaner base (or one with a hole punched in the perimeter wall or part of the wall broken away) along with a new plastic fan, the suction or vacuum power is increased to as good as, and in many cases to be better than, the original vacuum power. In addition, the incidence of subsequent damage to the plastic fan blades with the liner installed is substantially reduced as the metal plate does not scour or chip so that objects entering the chamber, as aforesaid, are smoothly swept around the chamber and discharged through the outlet. The fan blades may be kept in a low cost plastic form and will not, in the presence of this innovative liner, be damaged by paper clips, stones, buttons, etc.

Thus, new vacuum cleaners can be made more powerful by reducing the fan unit clearances, and worn or catastrophically ruined fan chambers can be rehabilitated to "new" working condition without the added expense of total replacement of the base. Further, the installation of the liner is made expeditious and with extreme accuracy with the novel clamp and without much dismantling of the base, a labor cost saving by itself. This new, inventive liner results in better overall operation, reduced future maintenance and allows inexpensive plastic fan blades to be continually used in the presence of what would otherwise be destructive objects such as paper clips, buttons, coins, rocks, etc. The vacuum cleaner can thusly handle a greater variety and a larger volume of debris during cleaning operations than a brand new vacuum cleaner with less possibility of early failure.

DETAILED DESCRIPTION OF THE INVENTION

While this detailed description will be of the inventive liner and clamp in use with an upright vacuum cleaner, it is clearly applicable to any centrifugal fan unit of like design in a wide variety of industrial, commercial and private use.

Figure 1:
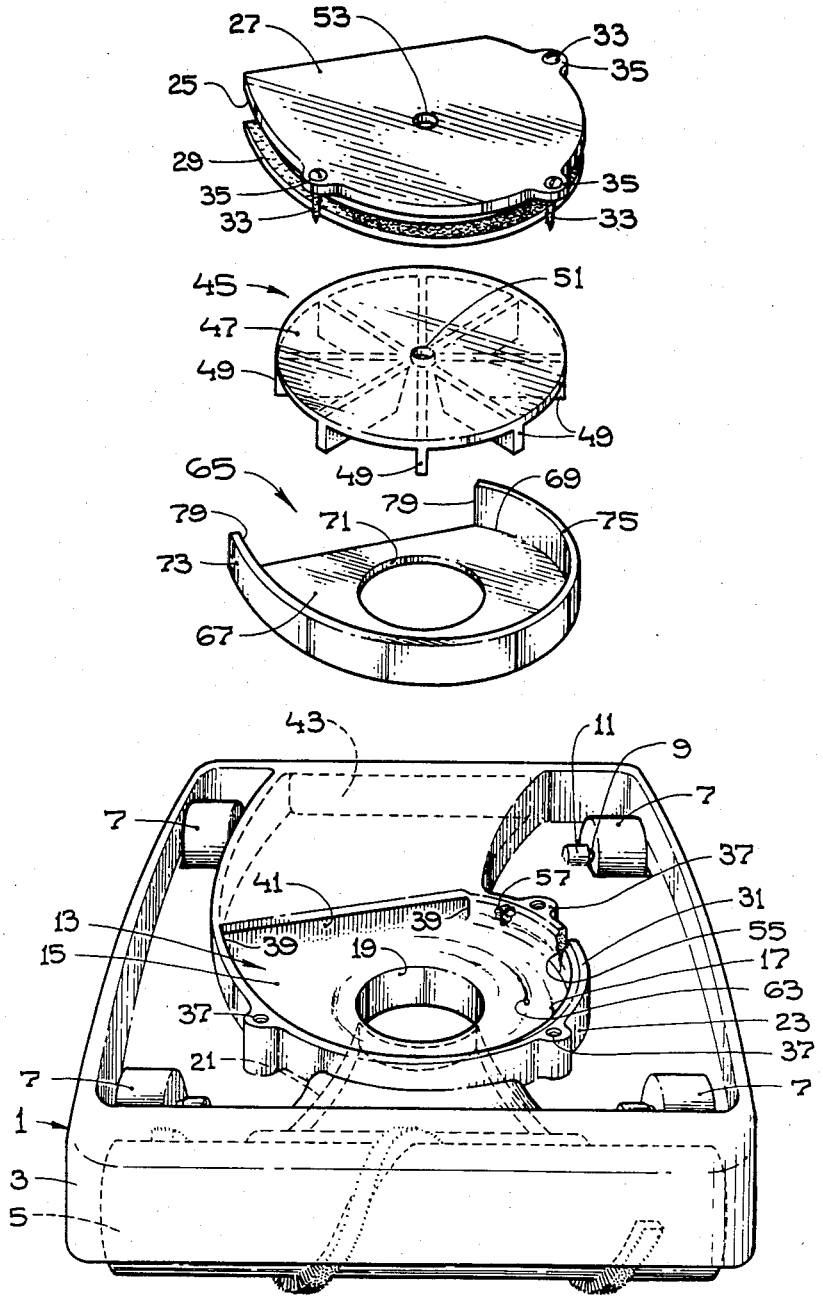
FIG. 1 is an exploded view of a typical upright vacuum cleaner centrifugal fan unit in a typical vacuum cleaner base showing the outline and positioning of the fan components and the positioning therein of the liner of this invention.

FIG. 1 shows a centrifugal fan unit housed in a typical vacuum cleaner base 1, said base is injection molded or cast plastic or lightweight metal and houses the common vacuum cleaner components such as a rug or floor brush chamber 3, for receipt of a cylindrical rug-beating brush 5 (shown partially in dotted outline) and rollable support wheels 7 mounted axles 9 in mounts 11. The centrifugal vacuum fan is defined in base 1 by a fan chamber 13 having a first flat lower chamber surface 15 (also see FIG. 2) that is flat and molded or cast into or as part of base 1. Surface 15 is terminated at the outer edge thereof by an involute-shaped perimeter 17 and at the inner edge thereof by a chamber inlet 19 that is in air-flow communication with floor brush chamber 3 through a duct 21 (shown in dotted outlines).

An outer wall 23 surrounds perimeter 17 and extends upward therefrom and is adapted to receive thereupon a second parallel flat involute-shaped plastic chamber surface 25 formed on the bottom of chamber plate 27 in sealed engagement therewith through a seal ring 29 positioned in groove 31 to provide an airtight fan chamber 13 when chamber surfaces 15 and 25 are fastened together with screws 33 through ears 35 in plate 29 and into seats 37 molded into base 1. Outer wall 23 terminates at a pair of opposed edges 39 that form a chamber outlet 41 that is communicated to an air-dirt (debris) separator bag (not shown) through exhaust duct 43.

A centrifugal fan 45, comprising a flat fan plate 47 with a series of upstanding radial fan blades or vanes 49, is rotatably mounted at its center 51 on a motor shaft (not shown), that enters or penetrates fan chamber 13 through entrance hole 53 in plate 27, to spin at high rpm to draw the dirt-ladened air stream from floor brush chamber 3 through duct 21 and chamber inlet 19 and force it out chamber outlet 41 into the air-dirt separator bag.

Figure 2:
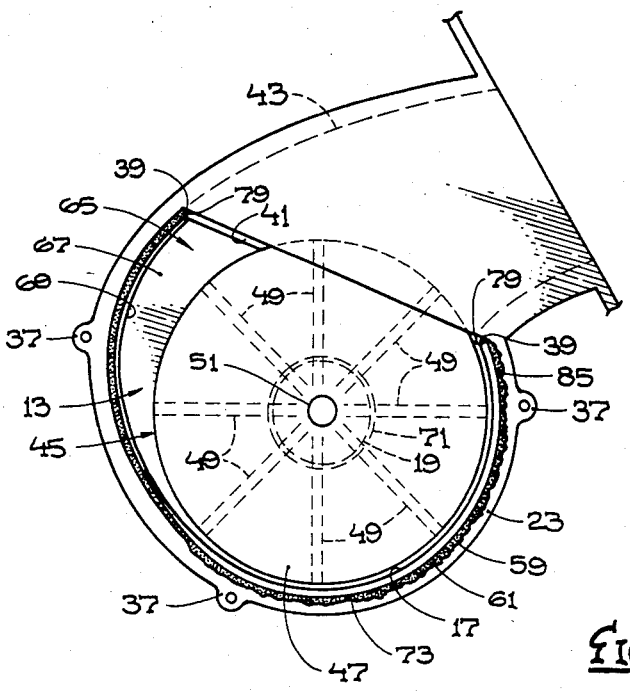
FIG. 2 is a top plan view of the liner of this invention operably positioned in a worn centrifugal fan chamber.
Figure 3:
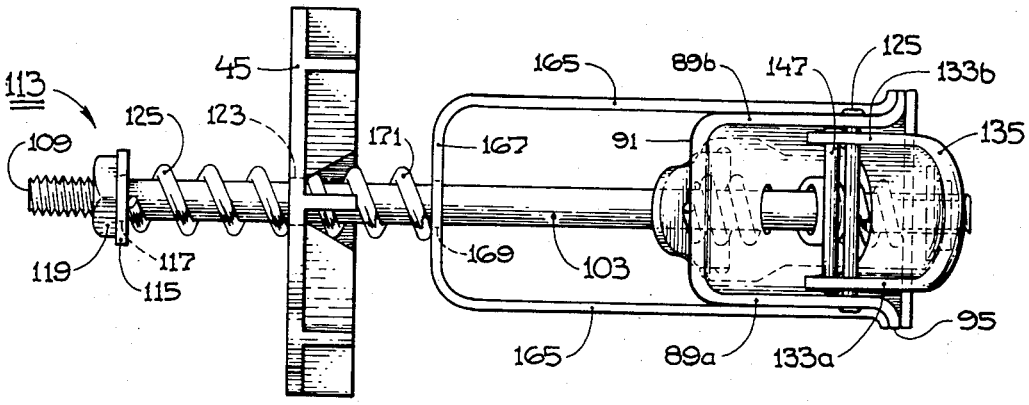
FIG. 3 is a bottom plan view of the embodiment of the portable installation clamp of this invention.
Figure 4:
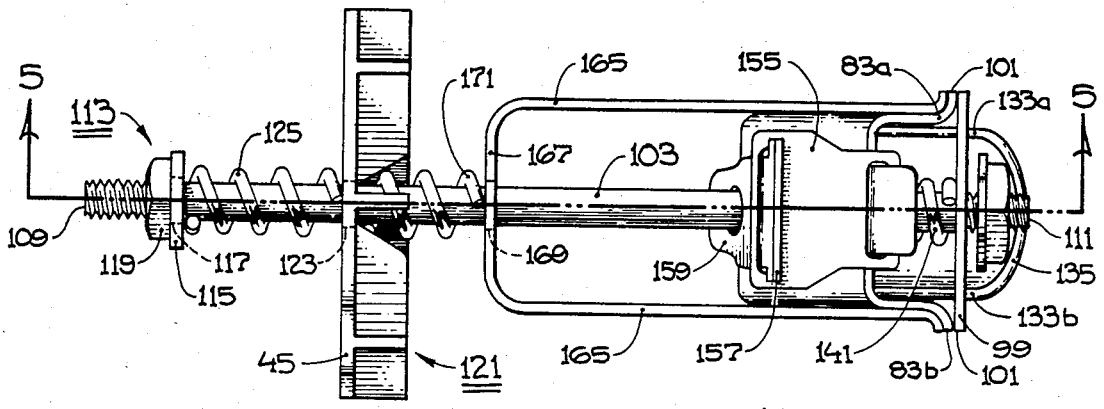
FIG. 4. is a top plan view of the embodiment shown in FIG. 3.
Figure 5:
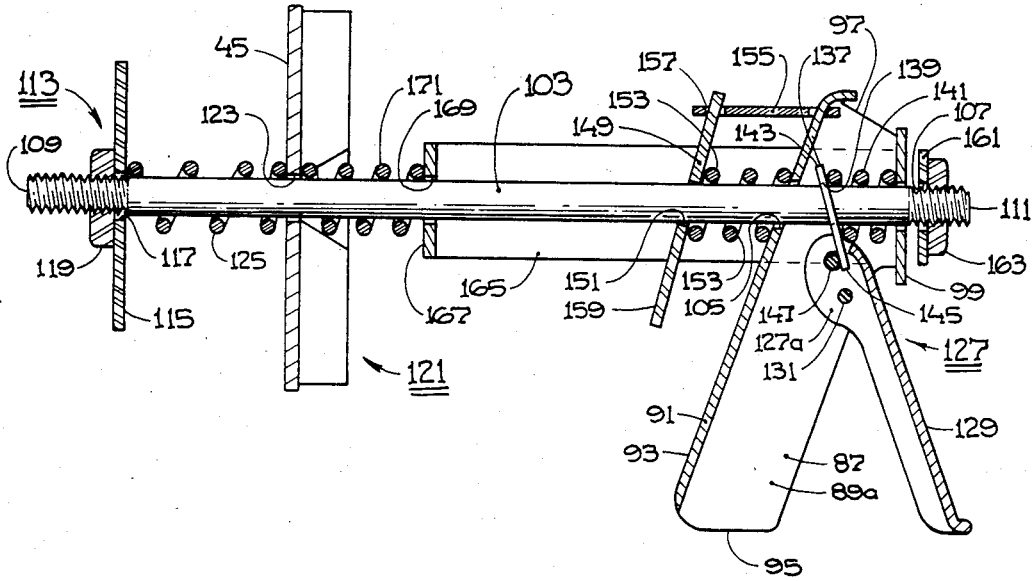
FIG. 5 is a sectional side view of the same embodiment shown taken along lines 5—5 in FIG. 4.

Outer wall 23 is shown in FIG. 1 to contain a broken-out wall portion 55, typically caused by a paper clip, and a punctured hole 57 typically caused by a stone or nail or screw caught up in the fan unit while in normal cleaning operation. Without this invention, base 1 must be totally replaced as broken-out wall portion 55 and hole 57 will reduce the vacuum power of the vacuum cleaner to an unacceptable low level and allow ejectment of dirt back onto the floor. In FIG. 2, wall 23 is shown to be eroded from its original surface 59 to a jagged surface 61 caused by ordinary wear and tear including the impingement of hard objects on the softer plastic outer wall 23. Also in FIG. 1, first chamber surface 15 is shown to have areas of wear 63 caused by scouring action of the hard objects on the softer plastic surface 15; such wear does not occur anywhere near this extent on second chamber wall 25 because it is protected by adjacent fan plate 47.

This inventive metal liner is shown generally at 65 and comprises a flat metal plate 67 having an outer involute-shaped perimeter 69 substantially the same size and outline as first flat chamber surface 15 in its new, unused condition and an inner edge 71 of similar shape and location with slightly larger than chamber inlet opening 19. Outer perimeter 69 is for alignment of the liner in the original convolute position: inner edge 71 is slightly back or receded from inlet opening 19 such as $\frac{1}{8}$ to $\frac{1}{4}$ inch to prevent incoming hard objects, such as paper clips, nails, rocks, etc. from striking edge 71 and raising permanent burrs or sharp points in the metal that might interfere with the free rotation of fan blades 49.

An upstanding metal wall 73 extends upward from flat plate 67 and is either connected to flat plate 67 or, more preferably, is actually a part of plate 67 deformed, by known stamping or pressing operations, into a unitary structure. Metal wall 73 terminates at top edge 75 to provide a height sufficient to span the vertical distance between first chamber surface 15 and second surface chamber 25 when said surfaces are assembled into an air-tight assembly as aforesaid.

Metal wall 73 terminates at side edges 79 that correspond to outer chamber wall edges 39 that form chamber outlet 41. When liner 65 is placed in a worn base chamber and metal wall edges 79 are aligned in tight registration with chamber outer wall edges 39 and thereafter liner 65 is fastened to first chamber surface 15 by fastening means such as adhesives or glues such as Bond 2000 Industrial (trademark) and Perma-Bond (trademark) said liner 65 has completey rehabilitated base 1 and improved the suction power of the vacuum cleaner from near zero back to the original (or better) suction power of a new unit.

Flat plate 67 now offers a protective metal, non-scouring. non-chipping barrier over worn plastic chamber surface 15 and metal wall 73 has corrected the huge gap, between the ends of fan blades 49 and eroded surface 61 of outer chamber wall 23, back to a closer "as new" tolerance with improved suction power and an abrasion resistant surface.

Liner 65 can be made from virtually any material that is harder than the material such as plastic or aluminum making up fan chamber 13: however, for economy and ease of manufacture, it is desirable to make liner 65 from easily deformable metals such as low carbon steel, wrought iron or mild steel. Other metals may be desired for special circumstances, however, ordinarily galvanized sheet metal has been found to be extremely desirable. The thickness of flat plate 67 and metal wall 75 must, of necessity, be thin enough not to interfere with rotation 1 of fan 45; however, the exact choice of thickness is left to the discretion of the practitioner. Ordinary galvanized and ungalvanized 26-gauge sheet metal has been found to work exceptionally well and meet all the goals of this invention. For instance, the following tests were conducted using liners made of 26-gauge galvanized sheet metal.

TEST 1

A new Eureka (trademark) model 688 Sanitaire (trademark) upright vacuum cleaner was fitted with a vacuum gauge on the intake nozzle.

A

New base, no bag, no (inventive) liner, measured 23 inches water suction.

B

Same base, no bag, installed inventive liner, measured 24.5 inches water suction.

TEST 2

A used Eureka (trademark) model 2055A upright vacuum cleaner was fitted with a vacuum gauge on the intake nozzle.

A

With used fan, no (inventive) liner, measured 20 inches water suction.

B

With new fan, no (inventive) liner, measured 20 inches suction.

C

With new fan, installed inventive liner, measured 24 inches water suction.

TEST 3

A used Eureka (trademark) model 688 upright vacuum cleaner was fitted with a new base and new fan (no inventive liner). Unit plugged in and turned on.

A

One small nail was introduced into the intake, unit shut opened opened up—result: one broken fan blade.

B

Installed inventive liner, replaced broken fan with new fan, unit turned back on, four small nails introduced one-at-a-time. Unit shut down, opened up—result: no damage to fan or to liner.

TEST 4

A used Eureka (trademark) model 2085A upright vacuum cleaner was fitted with a new base and new fan (no inventive liner) Unit plugged in and turned on.

A

Four bolts, seven nails and six screws introduced into intake. Unit shut down, opened up—result: broken fan, gouged chamber surface, broken chamber wall.

B

Installed inventive liner, replaced broken fan with new fan, unit turned back on, same four bolts, seven nails and six screws introduced into intake. Unit shut down, opened up—result: No damage to fan, liner or chamber.

It has been found that even better results can be attained from the standpoint of longevity of life of the liner of this invention if a filler is used to take up the space between the outside of metal wall 73 and worn inside surface 61 of outer wall 23. FIG. 2 shows a filler material 85 placed in this worn space Such material as epoxy resin, cement, wall spackling, may be used and achieve the benefits of this invention. Pliable fillers such as Silicone rubber fillers and rubber caulking compounds have been found to produce superior performance.

The portable installation clamp of this invention comprises a clamp handle 87 formed of curved sheet metal and having a pair of opposed side walls **89*a* and 89*b* joined by a transverse front web 91 and being open at the rear to form a hand-grasping handle portion 93 terminating at a bottom end 95 and a top end 97. Top end 97 is closed over, at the rear of handle 87, by a transverse metal wall 99 joined thereto at outer edges or flanges 101** such as by welding or riveting.

A shaft 103 extends from handle 87, lying fore and aft therethrough, supported by and passing through apertures 105 and 107 formed respectively in the upper portion of front web 91 and centrally in wall 99. Shaft 103 terminates at ends 109 and 111 and is adapted for reciprocal movement vis-a-vis handle 87 as will hereinafter be explained.

Figure 6:
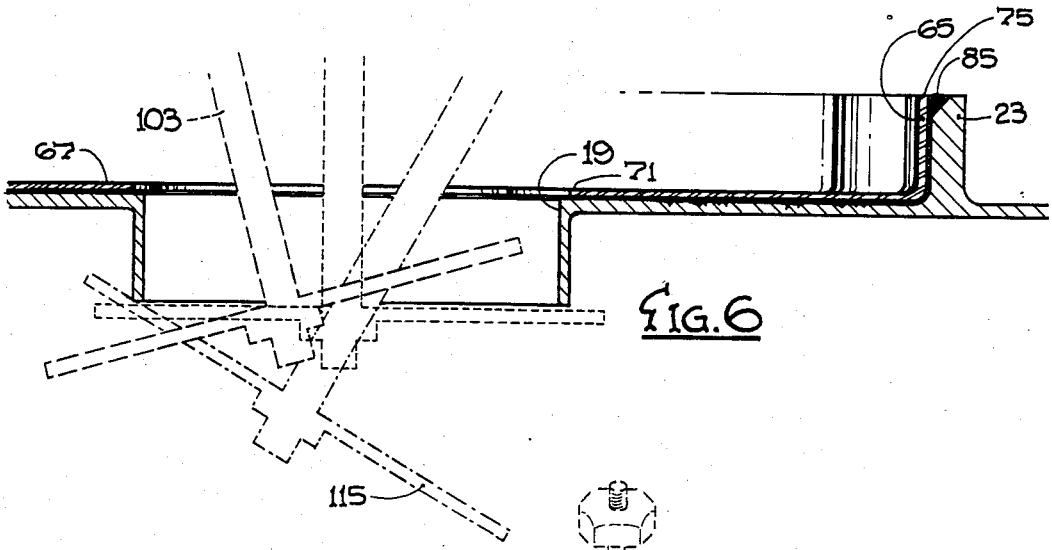
FIG. 6 is a side view in dotted outline showing how the clamp of this invention is installed in the vacuum cleaner base to begin the installation procedure.
Figure 7:
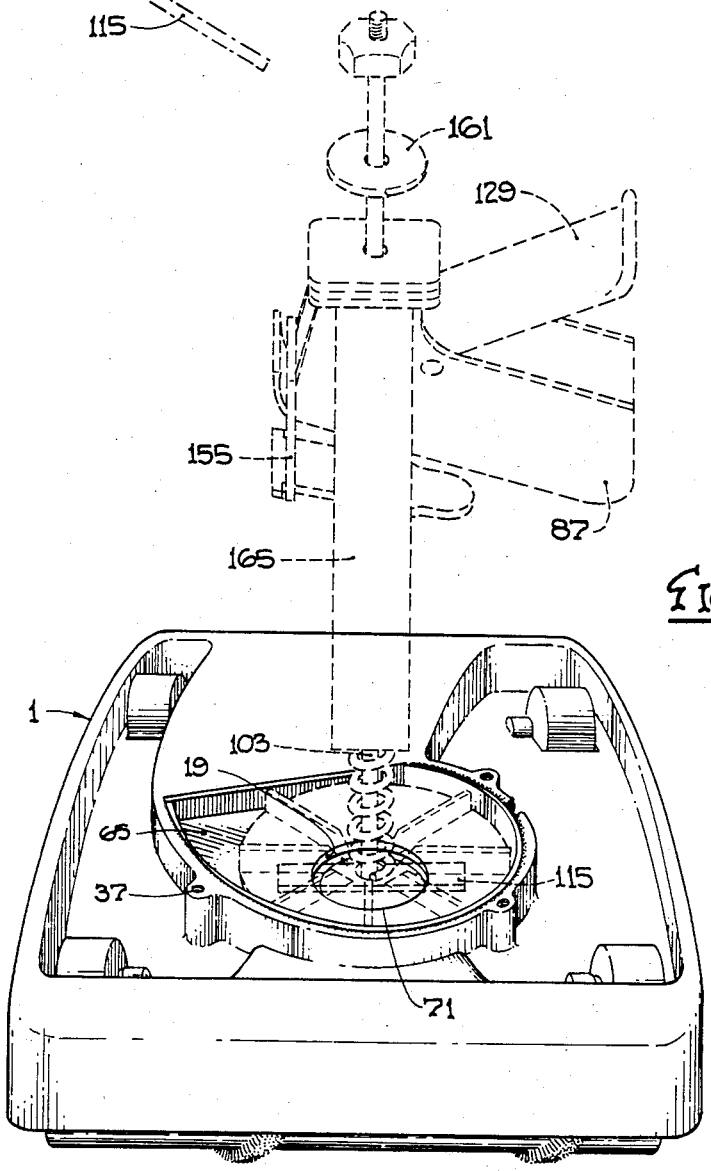
FIG. 7 is a perspective view showing how the clamp is used to install the liner.

A first means 113 is affixed to shaft 103 near end 109 for passing through inlet opening 19 and liner inner edge 71 for reversibly abutting the opposite side of base 1, i.e., for insertion into base 1 from one (bottom) side for clamping against the other (top) side. As shown, means 113 comprises a short narrow bar or strap 115, having a length greater than the width of inlet opening 19, mounted on shaft 103 at aperture 117 and affixed thereto by nut 119. Bar 115 may be inserted, along with shaft 103, through inlet opening 19 as shown in FIG. 6 by first tilting shaft 103 to one side and slipping one-half of bar 115 through opening 19 and then tilting shaft 103 in the opposite direction to allow the other half of bar 115 to pass through opening 19. Thereafter, shaft 103 is straightened to perpendicular position centrally in opening 19 so that the outer portions of bar 115 are brought into contact with the back of the base.

A second means 121 is provided for intimate contact with liner 65 to squeeze said liner into tight engagement with fan chamber 13. As shown, means 121 comprises a centrifugal fan blank 45 reversed and slidingly mounted on shaft 103 at aperture 123 A coil spring 125 is provided on shaft 103 between first means 113 and second means 121 to maintain them in spaced-apart relationship on said shaft for ease of use.

A third means 127 is provided to cooperate with handle 87 to cause shaft 103 to withdraw or move rearward into handle 87 and draw first means 113 and second means 121 together to squeeze liner 65 into fan chamber 13. Third means 127 comprises a squeezable trigger 129 pivotally mounted between handle sidewalls 89*a* and 89*b* by a shaft 131 near upper handle end 97. Trigger 129 contains opposed sidewalls 133*a* and 133*b* joined by a rear web 135 that is slightly smaller in cross-section than handle 87 to allow both handle 87 and trigger 129 to interfit one within the other upon squeezing them together. A drive plate 137 is slidingly mounted on shaft 103 through an aperture 139 and held at a slanted angle, by pressure from a spring 141, with its top end 143 resting against handle web 91 and its bottom end 145 resting against a cross-pin 147 that spans trigger sidewalls 133*a* and 133*b*. As trigger 129 is squeezed, bottom end 145 of drive plate 137 is urged rearward by cross-pin 147. Spring 141 forces drive plate top end 143 forward thus cocking and jamming drive plate 137 on shaft 103 and urging shaft 103 rearward in connection therewith. A catch plate 149 is similarly slidingly mounted on shaft 103 through an aperture 151 and held at a reverse slanted angle as drive plate 137 by forward pressure from a spring 153 and the rearward pull of a link 155 hingedly connected between catch plate top end 157 and handle top edge 97. Catch plate 149 extends downward terminating at release lever 159. During operation of said clamp, trigger 129 is squeezed toward handle 87 to cause drive plate 137 to jam on shaft 103 and be urged rearward by cross-pin 147. Reverse slanted catch plate 149 allows such rearward travel of shaft 103 but catches and jams thereon to prevent forward or return motion thereof when trigger 129 is released and allowed to move rearward. Thus, successive squeezing of trigger 129 brings means 113 and 121 toward each other to clamp liner 65 tightly in base 1. To remove said clamp, release lever 159 is pulled to straighten catch plate 149 and allow forward slippage of shaft 103 through aperture 151. Forward travel of shaft 103 is limited by a stop 161 mounted on shaft 103 near end 111 by nut 163 that abuts metal wall 99. A bumper wall 165 extends forward on both sides of handle 87 from rear wall 99 to a point beyond release lever 159, wherein a crosswall 167 is formed therebetween that has an aperture 169 formed therein through which shaft 103 passes. A strong spring 171 is located between cross-wall 167 and means 121 to provide strong clamp pressure between means 113 and 121.

What is claimed is:

1. In a plastic base of an upright vacuum cleaner that includes a plastic fan chamber defined by first and second flat involute-outlined plastic chamber surfaces spaced apart by an outer plastic wall terminating at edges defining a chamber outlet, a chamber inlet in the first chamber surface, and a centrifugal fan including a fan plate rotably mounted adjacent the second chamber surface and vanes radially mounted thereon for spinning within the chamber, the improvement of a retrofittable thin metal liner, adapted for adhesive attachment to the first chamber surface, and a portable installation clamp therefor, for temporarily clamping said liner tightly to the surface, said clamp fully manipulative from only one side of the vacuum cleaner base, said metal liner comprising:

(a) a flat metal plate having an outer-involute shaped perimeter substantially the same size and outline as the first chamber surface and having an inner edge of similar shape and location and slightly larger in size than the chamber inlet;

(b) upstanding metal wall attached to said plate around the outer perimeter thereof terminating at edges defining the chamber outlet and of a height sufficient to span the distance between the first and second chamber surfaces snd terminating at the top edge of the outer plastic wall;

(c) said liner aligned in tight registration with the terminating edges of the outer wall at the chamber outlet;

(d) adhesive means for mounting said liner in the chamber; said portable clamp comprising:

(e) a clamp handle;

(f) a shaft extending from said handle having first and second ends adapted for reciprocal motion;

(g) first means on said shaft adapted to pass through the first chamber surface out through the chamber inlet for reversibly abutting the opposite side of the first chamber comprising a strap transversely and securely mounted on said shaft having a length greater than the width of the chamber inlet and adapted to pass through the chamber inlet by tilting said shaft first one way, to pass one part of said strap through, then tilting said shaft the other way to pass the other part through and thereafter straighten said shaft to cause said strap to span the chamber inlet on both sides thereof and abut the back side of the base parallel to the plane of said flat metal plate;

(h) second means slidingly received on said shaft, including a surface substantially similar to the shape and size of said flat metal plate of said liner, for abutting said liner and providing full pressure over the entire surface thereof;

(i) third means cooperative with said handle to cause said shaft to withdraw and draw said first means and said second means under intense hand pressure for squeezing and holding said liner into tight registration with said first chamber surface during the entire adhesive operation, comprising a squeezable trigger pivotally mounted to said handle, a drive plate having an aperture formed therein for receipt therethrough of said shaft and adapted to tilt and jam against said shaft under action of said trigger, forcing said plate and shaft rearward of said handle and to slide in a forward direction independent of said shaft under bias pressure when released by said trigger, a catch plate having an apertured formed therein for receipt therethrough of said shaft and adapted to slide independent of said shaft as said shaft moves in a rearward direction and to tilt and jam against said shaft and prevent forward motion thereof when said trigger is released and reset for another cycle of urging said shaft in a rearward direction, means biasing said trigger apart from said handle and biasing said drive plate in sliding contact with said shaft adapted to be overcome by hand squeezing to actuate said drive plate and drive said shaft rearward and urge said first means and said second means together, means biasing said catch plate to allow said shaft to pass rearward therethrough and tilting and jamming thereon to prevent forward motion thereof, and means in co-operation with said catch plate to overcome said bias means to allow release and forward motion of said shaft to release said clamp pressure.

2. The metal liner and portable installation clamp therefor of claim 1 further including means biasing said second means forward of said handle to prevent the clamping pressure, developed between said first and second means by squeezing said trigger from damaging said third means and a stop on said shaft for contact with said handle to limit the forward travel of said shaft.

* * * * *